US007281965B2

(12) United States Patent
Torres

(10) Patent No.: US 7,281,965 B2
(45) Date of Patent: Oct. 16, 2007

(54) COMBINATION YO-YO AND TOP

(75) Inventor: Ulises Torres, Pasadena, CA (US)

(73) Assignee: SW14 Group LLC, Sherman Oaks, CA (US)

( * ) Notice: Subject to any disclaimer, the term of this patent is extended or adjusted under 35 U.S.C. 154(b) by 0 days.

(21) Appl. No.: 11/106,138

(22) Filed: Apr. 14, 2005

(65) Prior Publication Data

US 2005/0233674 A1 Oct. 20, 2005

Related U.S. Application Data

(60) Provisional application No. 60/562,016, filed on Apr. 14, 2004.

(51) Int. Cl.
*A63H 1/30* (2006.01)
*A63H 1/00* (2006.01)

(52) U.S. Cl. ..... 446/250; 446/256; 446/263

(58) Field of Classification Search ..... 446/236, 446/250, 247, 248, 266, 256, 259, 263
See application file for complete search history.

(56) References Cited

U.S. PATENT DOCUMENTS

| | | | | |
|---|---|---|---|---|
| 2,579,022 | A | 12/1951 | Spencer et al. | |
| 2,891,351 | A | 6/1959 | Madaras et al. | |
| 3,413,753 | A | 12/1968 | Colmer, Jr. | |
| 3,936,974 | A | 2/1976 | House | |
| 5,017,172 | A * | 5/1991 | Seifert | 446/250 |
| 5,683,284 | A * | 11/1997 | Christen | 446/233 |
| 6,322,419 | B1 | 11/2001 | Dermenci | |
| 6,695,670 | B1 * | 2/2004 | Driscoll et al. | 446/242 |

FOREIGN PATENT DOCUMENTS

| | | | |
|---|---|---|---|
| JP | 411169560 | A | 6/1999 |
| JP | 02000037564 | A | 2/2000 |
| JP | 02000093660 | A | 4/2000 |
| JP | 2003135859 | A * | 5/2003 |

OTHER PUBLICATIONS

Computer translation in of JP reference 2003-135859, 6 pages.*

* cited by examiner

*Primary Examiner*—Robert E. Pezzuto
*Assistant Examiner*—Alex F. R. P. Rada, II
(74) *Attorney, Agent, or Firm*—Sandra P Thompson; Buchalter Nemer

(57) ABSTRACT

The present invention is directed to a combination yo-yo and top device comprising first and second yo-yo body halves, a hollow dowel element detachably connecting one of the yo-yo body halves to the other, a ball bearing element mounted on the hollow dowel element between the yo-yo body halves, a first flywheel assembly having an elongated flywheel axle, wherein the first flywheel assembly is adapted for attachment to the yo-yo body, a second flywheel assembly adapted for attachment to the yo-yo body, a string element having a first end coupled to the hollow dowel element, a power element adapted for attachment to either the first flywheel assembly or the second flywheel assembly to activate both flywheel assemblies, and, at least one removable top component adapted to be secured to the yo-yo body to convert the device from a yo-yo to a top.

9 Claims, 11 Drawing Sheets

COMBINATION YO-YO AND TOP

CROSS-REFERENCE TO RELATED APPLICATION

This application is a continuation of U.S. provisional patent application Ser. No. 60/562,016, filed on Apr. 14, 2004, titled "Combination Yo-Yo and Top".

TECHNICAL FIELD

The present invention is directed to a combination yo-yo and top device. More particularly, the present invention is directed to a unique, novel, and nonobvious toy yo-yo and top device that incorporates a pair of flywheel assemblies and a hollow dowel or core axle to provide a high performance toy yo-yo and top device that can spin at very fast speeds and provide amusement and enjoyment to both children and adults.

BACKGROUND ART

Toy yo-yo's and tops have been used for centuries. Such known yo-yo's and top devices are typically limited in their structural configuration for use as one or two spinning devices, and such devices can have complex constructions which are expensive to make and difficult to modify or assemble. Moreover, many of the known yo-yo's, tops, or combination yo-yo and top devices have a limited scope of play and do not have the capability of spinning at optimally fast speeds.

Accordingly, there is a need for a new and improved combination yo-yo and top that overcomes the problems and limitations associated with known yo-yo's, tops, and combination yo-yo and top devices.

SUMMARY OF INVENTION

The present invention satisfies these needs, as well as provides a unique and advantageous combination yo-yo and top. None of the known yo-yo's, tops or combination yo-yo and top devices provide all of the numerous advantages of the present invention. Unlike known yo-yo's, tops, and combination yo-yo and top devices, the combination yo-yo and top of the present invention is designed to achieve a faster spinning motion and speed than many known yo-yo's, tops, and combination yo-yo and top devices, and thus provides for greater amusement, variety of play, and high performance play. In addition, the combination yo-yo and top of the present invention is constructed from parts in a manner which provides for easy assembly and additional play value. Moreover, the present invention can be used as either a high performance toy yo-yo or a high performance toy top. Finally, the use of a power element, such as a zip cord or electric charger, with the present invention adds an element of activity and play that is not present in other yo-yo's, tops, and combination yo-yo and top devices.

The present invention is directed to a combination yo-yo and top device comprising: a yo-yo body having first and second yo-yo body halves each having an interior side, an exterior side, a rim, and a central opening; a hollow dowel element detachably connecting one of the yo-yo body halves to the other; a ball bearing element mounted on the hollow dowel element between the yo-yo body halves; a first flywheel assembly having an elongated flywheel axle, wherein the first flywheel assembly is adapted for attachment to the yo-yo body; a second flywheel assembly adapted for attachment to the yo-yo body; a string element having a first end coupled to the hollow dowel element; a power element adapted for attachment to either the first flywheel assembly or the second flywheel assembly to activate both flywheel assemblies; and, at least one removable top component adapted to be secured to the yo-yo body to convert the device from a yo-yo to a top.

The power element may comprise an elongated zip cord, a battery-operated electric charger component, or another suitable power element. The first flywheel assembly of the present invention preferably comprises a first flywheel having a central opening and a first gear portion having a central opening, wherein the first gear portion is adjacent the first flywheel, such that the elongated flywheel axle is inserted through the first flywheel central opening and through the first gear central opening when the device is assembled. The second flywheel assembly of the present invention preferably comprises a second flywheel having a central opening and a second gear portion having a central opening, wherein the second gear portion is adjacent the second flywheel, such that the elongated flywheel axle is inserted through the second flywheel central opening and through the second gear central opening when the device is assembled.

The top component may comprise a first removable cover element for coupling to the exterior side of the first yo-yo body half, and a second removable cover element for coupling to the exterior side of the second yo-yo body half. Either the cover elements or the first and second yo-yo body halves may each contain at least two opposing slots. The device may further comprise one or more additional components comprising lighting components, electronic components, sound components, or miniature figure components.

The novel features of the present invention include a pair of interchangeable and removable flywheel assemblies with drive gears, where one of the flywheel assemblies has a flywheel axle. Further novel features include a hollow dowel or core axle that is attached at each end to each of the yo-yo body halves. The hollow dowel connects the two yo-yo body halves, and the flywheel axle is inserted through the hollow dowel to connect the two flywheels of the flywheel assemblies, so that the two flywheels always move together in synchronization. Each yo-yo body half has two preferably opposite slots for insertion of the power element, such as the zip cord. The invention may be manually operated with a zip cord and string, or can be used with an electric charger component that is preferably battery-operated.

The advantages of the present invention include such benefits to users as using the device as either a yo-yo or a top, making the yo-yo or top spin faster, providing interchangeable parts that can be disassembled and changed for a variety of looks and colors, and giving more fun and enjoyment to the user than many known devices. These and other features, aspects and advantages of the present invention will become better understood from the following description and appended claims.

DETAILED DESCRIPTION OF INVENTION

The present invention is directed to a novel and nonobvious combination yo-yo and top device. In particular, the present invention is directed to an improved combination toy yo-yo and top device that incorporates a pair of flywheel assemblies and a hollow dowel or core axle to provide a high performance toy yo-yo and top device that can spin at very fast speeds and provide amusement and enjoyment to both children and adults. Parts can be disassembled and changed for additional play.

Figure 1:
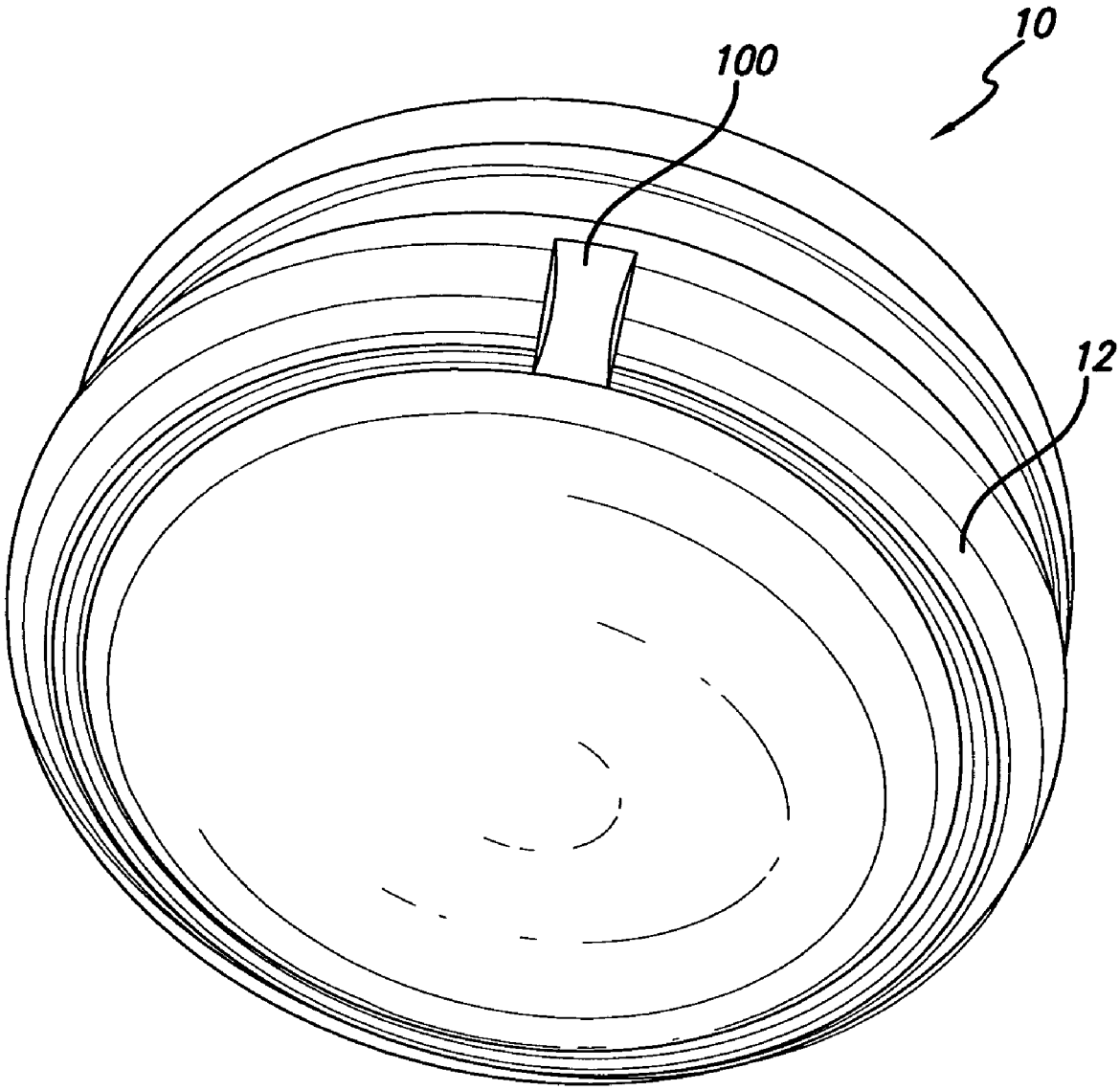
FIG. 1 is a perspective view of one embodiment of the device of the present invention showing the yo-yo configuration.
Figure 2:
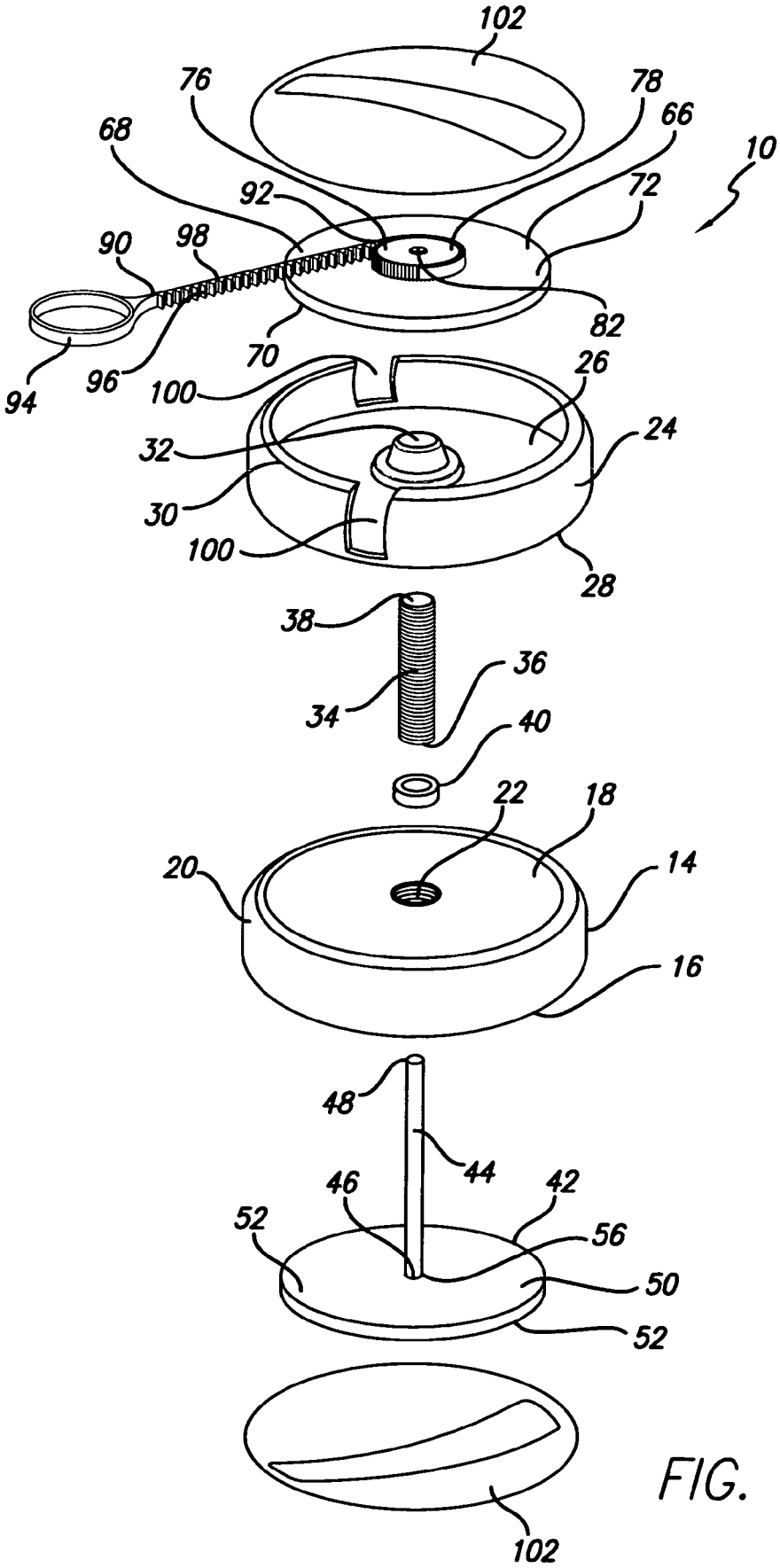
FIG. 2 is an exploded view of the yo-yo configuration of FIG. 1.
Figure 3:
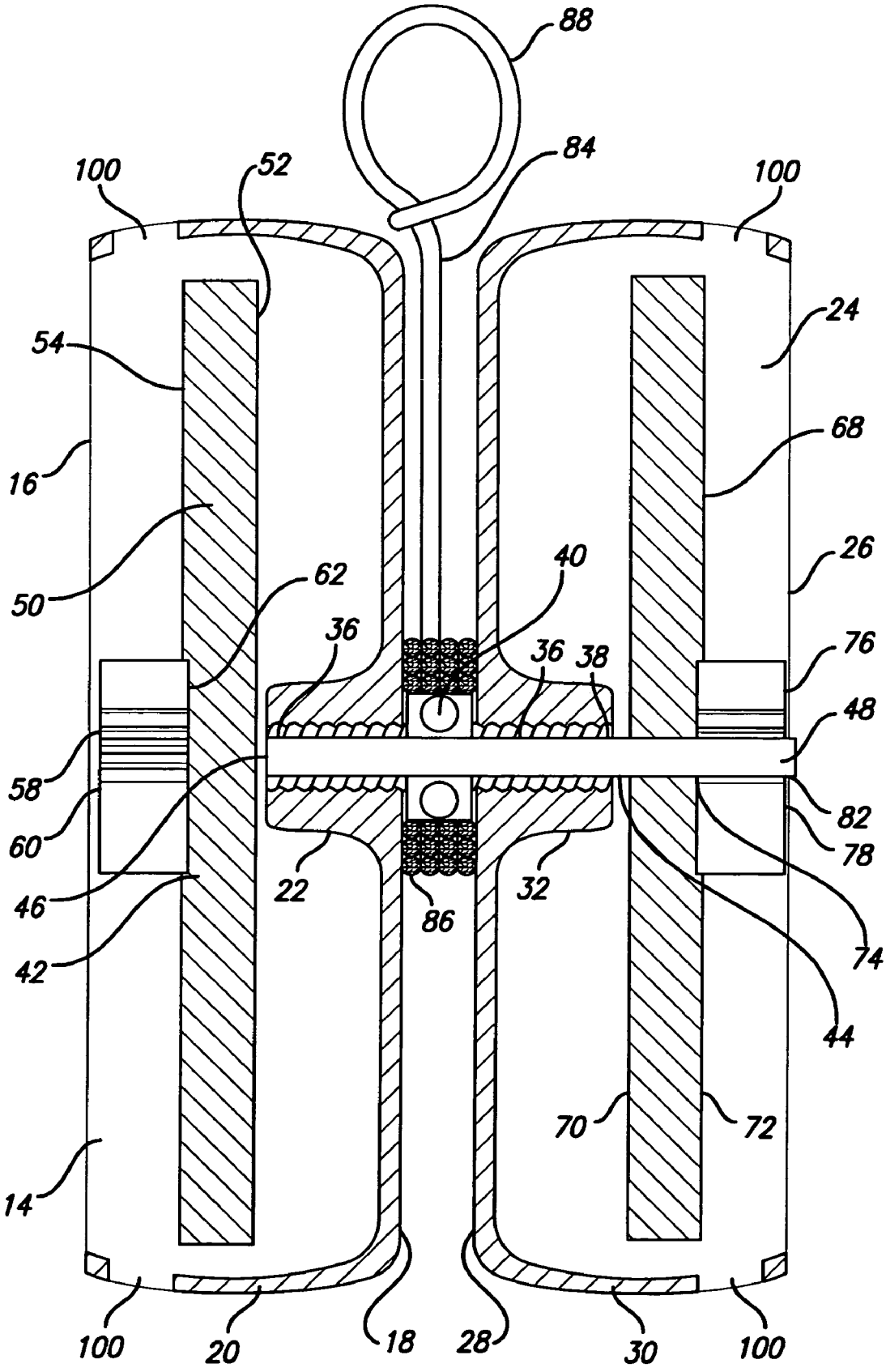
FIG. 3 is a sectional view taken through the diameter of the yo-yo configuration.
Figure 5:
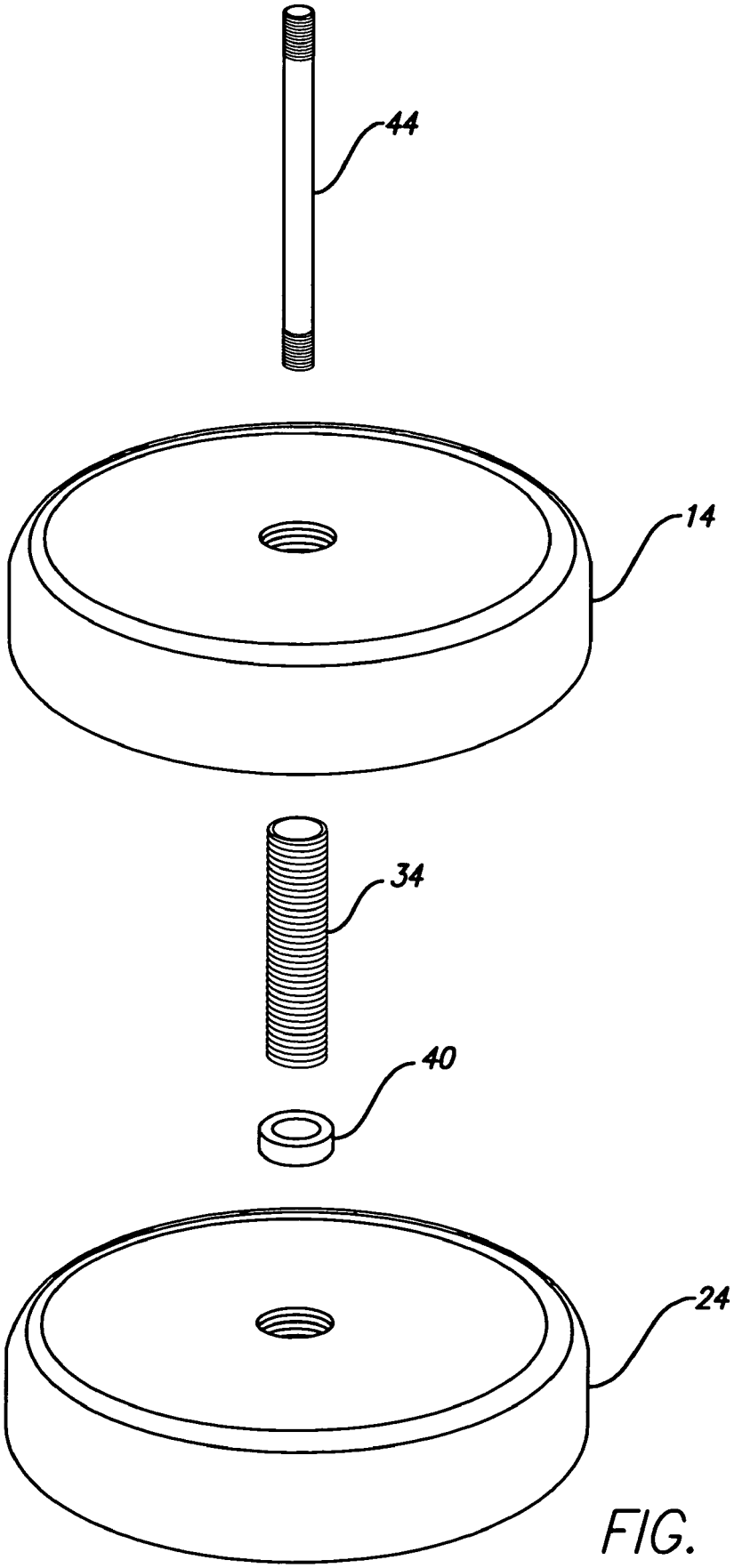
FIG. 5 is an exploded view of a partial yo-yo configuration.

FIG. 1 is a perspective view of one embodiment of the combination yo-yo and top device 10 of the present invention, and in particular, it shows the yo-yo configuration wherein the yo-yo configuration includes a yo-yo body 12. FIG. 2 shows an exploded view of the yo-yo configuration of FIG. 1 of the present invention. FIG. 3 is a sectional view taken through the diameter of the yo-yo configuration of the present invention. FIG. 5 is an exploded view of a partial yo-yo configuration of the present invention. As shown in FIG. 2, the device 10 comprises a substantially hollow first yo-yo body half 14 or disc. The first yo-yo body half 14 includes an exterior side 16, an interior side 18, a first rim 20 or middle portion, and a first yo-yo body half central opening 22. The device 10 further comprises a substantially hollow second yo-yo body half 24 or disc. The second yo-yo body half 24 includes an exterior side 26, an interior side 28, a second rim 30 or middle portion, and a second yo-yo body half central opening 32. The yo-yo body halves may be made of plastic, aluminum, stainless steel, or another suitable material, and are preferably disc shaped or circular in configuration. However, other suitable shapes can also be used. The yo-yo body halves are opposite facing to each other.

Figure 13:
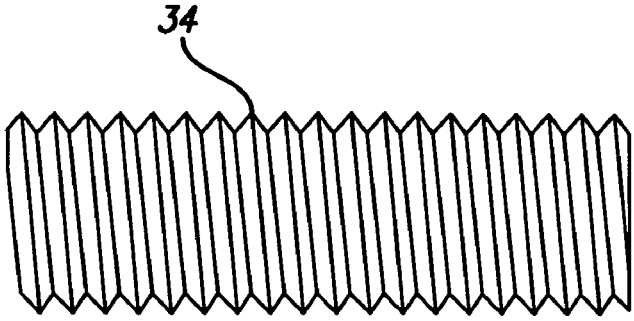
FIG. 13 is a side view of the threaded hollow dowel.
Figure 14:
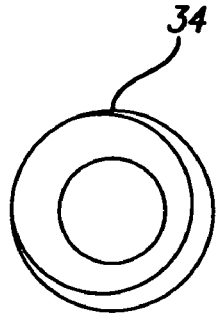
FIG. 14 is a top view of the threaded hollow dowel of FIG. 13.

The device 10 further comprises a hollow dowel element 34 or core axle having a first end 36 and a second end 38. The hollow dowel 34 detachably connects the first yo-yo body half 14 to the second yo-yo body half 24 in spaced relation to each other. Preferably, the first end 36 of the hollow dowel 34 is adapted for insertion into the first yo-yo body half central opening 22, and the second end 38 of the hollow dowel 34 is adapted for insertion into the second yo-yo body half central opening 32. The hollow dowel element 34 is preferably elongated and threaded on its exterior. The hollow dowel 34 may be made of stainless steel, aluminum, titanium, plastic, wood, or another suitable material. FIG. 13 is a side view of the threaded hollow dowel 34, and FIG. 14 is a top view of the threaded hollow dowel of FIG. 13. The device 10 further comprises a ball bearing element 40 adapted to be mounted on the first end 36 of the hollow dowel 34 between the interior sides 18, 28 of the yo-yo body halves 14, 24. The ball bearing 40 has a hollow center and may be made of metal or another suitable material.

The device 10 further comprises a first flywheel assembly 42. The first flywheel assembly 42 comprises an elongated flywheel axle 44 having a first end 46 and a second end 48. Preferably, the flywheel axle 44 is solid. Preferably, the first end 46 and the second end 48 each have a square shaped cut-out portion (see FIG. 22). The square shaped cut-out portion provides edges to securely attach the flywheel axle 44 to each flywheel assembly, so that the axle does not slip. Other shapes that provide edges may also be used. The first flywheel assembly 42 further comprises a first flywheel 50 having an interior side 52, an exterior side 54, and a first flywheel central opening 56. Preferably, the first flywheel 50 is circular or round in shape but does not necessarily have to be solid. The flywheel may be configured in other shapes as well, such as including spokes or holes (see FIG. 15). The first flywheel assembly 42 further comprises a first gear portion 58 (see FIG. 3) having a first side 60 and a second side 62, and first gear portion central opening 64. The second side 62 of the first gear portion 58 is preferably adjacent the exterior side 54 of the first flywheel 50. The first flywheel assembly 42 is adapted for attachment to the yo-yo body 12, and in particular, is adapted for attachment to the first yo-yo body half 14. When the first flywheel assembly 42 is assembled, preferably the elongated flywheel axle 44 is inserted through the first flywheel central opening 56 and through the first gear central opening 64. The second end 48 of the axle 44 is adapted for insertion into the central opening 22 of the first yo-yo body half. The first flywheel assembly 42 is preferably made of metal, aluminum, stainless steel, plastic, a combination thereof, or of another suitable material.

The device 10 further comprises a second flywheel assembly 66 adapted for attachment to the yo-yo body. The second flywheel assembly 66 comprises a second flywheel 68 having an interior side 70, an exterior side 72, and a second flywheel central opening 74. Preferably, the second flywheel 66 is circular or round in shape but does not necessarily have to be solid. The flywheel may be configured in other shapes as well, such as including spokes or holes. The second flywheel assembly 66 further comprises a second gear portion 76 having a first side 78 and a second side 80, and second gear portion central opening 82. The second side 80 of the second gear portion 76 is preferably adjacent the exterior side 72 of the second flywheel 68. The second flywheel assembly 66 is adapted for attachment to the yo-yo body 12, and in particular, is adapted for attachment to the second yo-yo body half 24. When the device 10 is fully assembled, preferably the elongated flywheel axle 44 is inserted through the second flywheel central opening 74 and through the second gear central opening 82. The second flywheel assembly 66 is preferably made of metal, aluminum, stainless steel, plastic, a combination thereof, or of another suitable material. Preferably, the device is of an optimal size, weight, and mass combination to maximize the effect of the spinning flywheels. The flywheels of the flywheel assemblies are removable and interchangeable and can easily be disassembled and reassembled.

Figure 7:
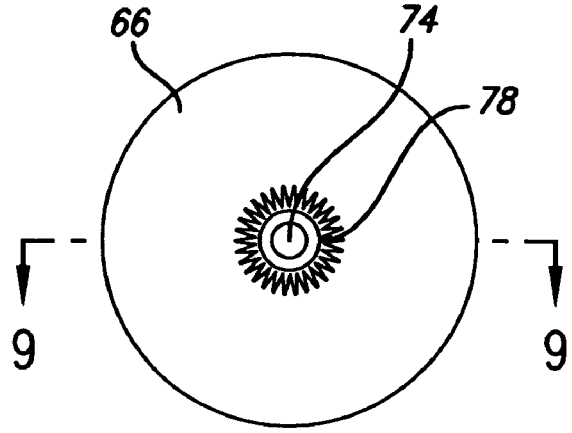
FIG. 7 is a top view of the second flywheel assembly.
Figure 8:
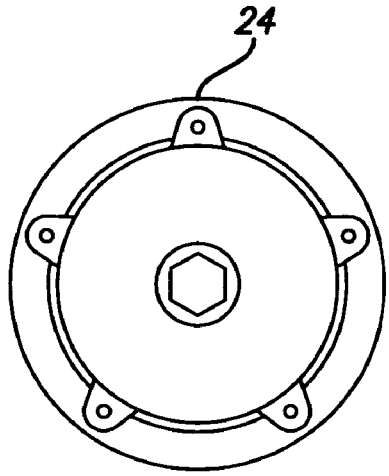
FIG. 8 is a top view of the first cover element.
Figure 9:
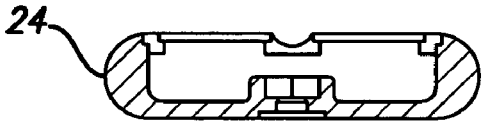
FIG. 9 is a cross-sectional view taken along line 9-9 of FIG. 7.
Figure 15:
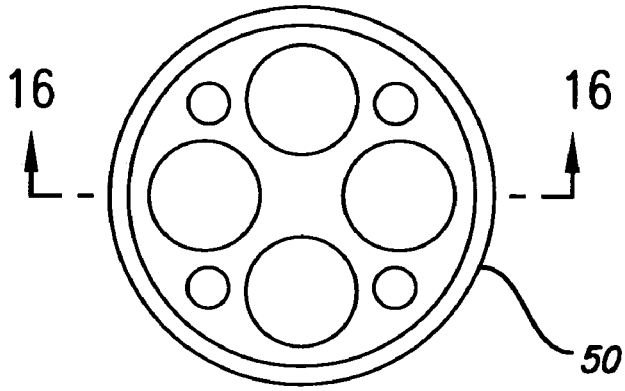
FIG. 15 is a top view of the first flywheel assembly.
Figure 16:
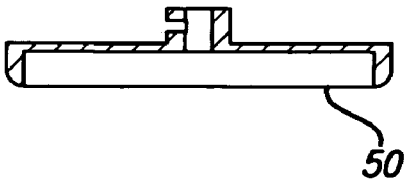
FIG. 16 is a cross-sectional view taken along line 16-16 of FIG. 15.
Figure 17:
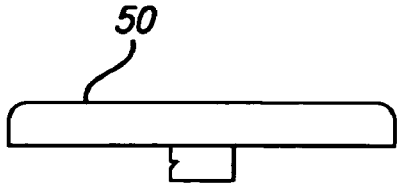
FIG. 17 is a side view of the first flywheel assembly of FIG. 15.
Figure 18:
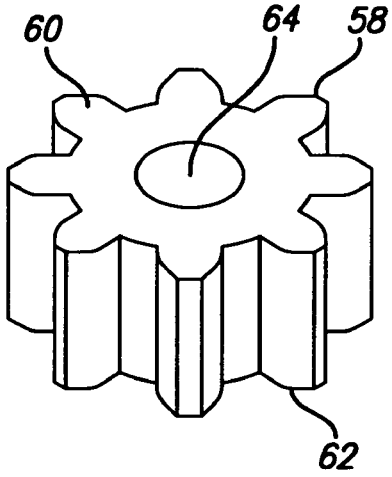
FIG. 18 is a perspective view of the flywheel gear drive.
Figure 19:
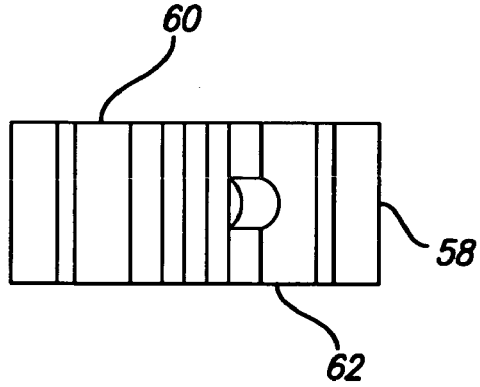
FIG. 19 is a side view of the flywheel gear drive of FIG. 18.
Figure 22:
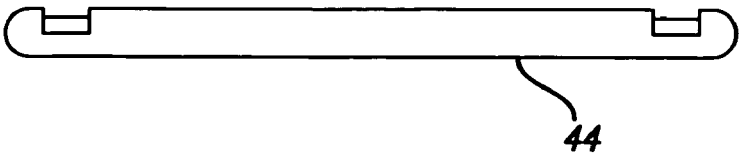
FIG. 22 is a side view of the flywheel axle of the present invention.

FIG. 7 is a top view of the second flywheel assembly. FIG. 9 is a cross-sectional view of the flywheel assembly taken along line 9-9 of FIG. 7. FIG. 15 is a top view of the first flywheel assembly. FIG. 16 is a cross-sectional view taken along line 16-16 of FIG. 15. FIG. 17 is a side view of the first flywheel assembly of FIG. 15. FIG. 18 is a perspective view of the flywheel gear drive. FIG. 19 is a side view of the flywheel gear drive of FIG. 18. FIG. 22 is a side view of the flywheel axle of the present invention.

The device 10 of the present invention further comprises a string element 84 (FIG. 3) having a first end 86 and a second end 88. The first end 86 of the string 84 is preferably coupled to or wound around the exterior of the hollow dowel element when the device is assembled. The second end 88 may be in the form of a ring or opening to enable a user to insert a finger through the ring or opening to hold and play with the device. The string element 94 can not only manually operate the yo-yo but it can manually operate the top too. The string can be wound around the hollow dowel but not knotted or secured and instead stay loose, and when the device is used as a top, the string can be quickly unwound to power the top and cause it to spin, and the string can separate from the top when it is completely unwound leaving the top to spin on its own.

Figure 11:
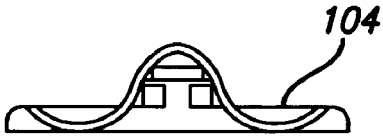
FIG. 11 is a cross-sectional view taken along line 11-11 of FIG. 10.
Figure 12:
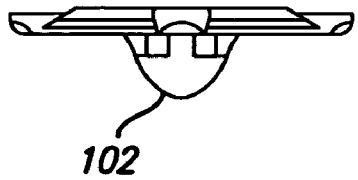
FIG. 12 is a side view of the first cover element.

The device 10 of the present invention further comprises a power element adapted for attachment or coupling to either the first flywheel assembly 42 or the second flywheel assembly 66 to activate both flywheel assemblies when the device is in use. The power element preferably comprises an elongated zip cord 90 (FIG. 2) having a first end 92 and a second end 94, and a first side 96 and a second side 98. The zip cord is preferably made of plastic or another suitable material. The first side 96 of the zip cord may have ratcheted teeth in order to synchronize with the gear portions 58, 76 when the zip cord is pulled through or around the gear portions to activate the flywheel 50, 68. The zip cord 90 can activate either gear portion 58, 76, and since the flywheel assemblies 42, 66, including the flywheels 50, 68, are attached by the flywheel axle 44, when the zip cord is pulled over or through the gear portion, the activation of one flywheel simultaneously activates the other flywheel. The device is designed so that when in use, the flywheels, 50, 68 are activated simultaneously. As shown in FIG. 3, the rims 20, 30 of each of the respective first and second yo-yo body halves may each contain at least two slots 100 formed in each rim. In another embodiment, as shown in FIGS. 11 and 12, the cover elements 11, 12 may contain at least two slots 100 formed in each cover element. When the device is assembled, the zip cord 90 may be inserted through the slots 100 and pulled through the slots to activate both flywheels. The slots 100 in each rim and each cover element are preferably opposite each other. The second end 94 of the zip cord 90 may be in the form of a ring or opening to enable a user to insert a finger through the ring or opening to hold and pull the zip cord and play with the device. The power element may further comprise an electric charger component (not shown) having a first end and a second end adapted for attachment to the device, and in particular, for attachment to one of the gear portions 58, 76 to activate the gear portion and both flywheels 50, 68. The electric charger may be used in place of the zip cord and is preferably elongated. The yo-yo body may have an opening (not shown) for insertion of the electric charger device. The charger may also comprise a small gear (not shown) for connection with one of the gear portions 58, 76 to power the flywheels by electric motor rather than physical motion. The speed and sound sensations created by the spinning flywheels take place when the device is powered by the power element, such as the zip cord or charger.

Figure 4:
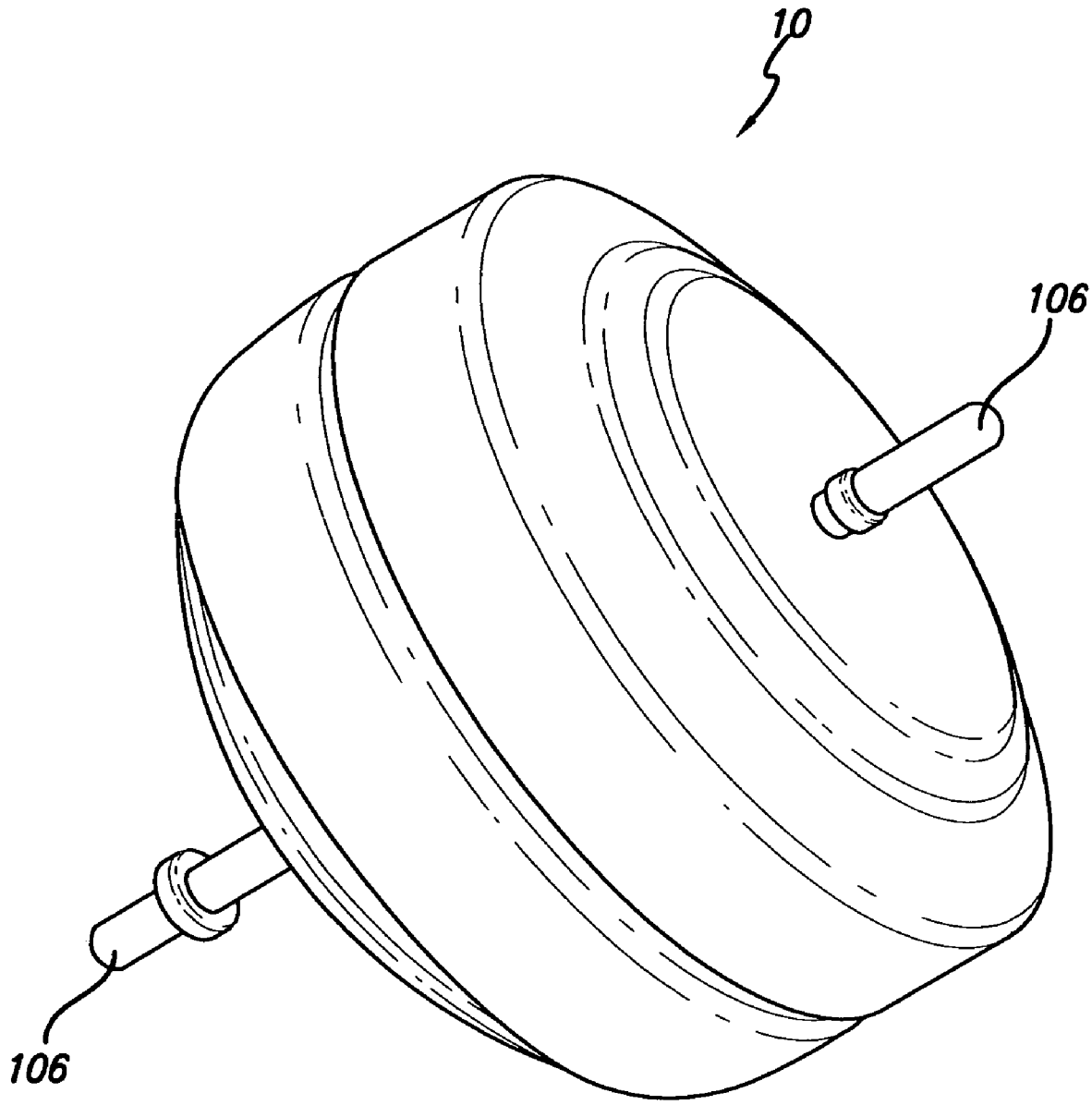
FIG. 4 is a perspective view of another embodiment of the device of the present invention.
Figure 6:
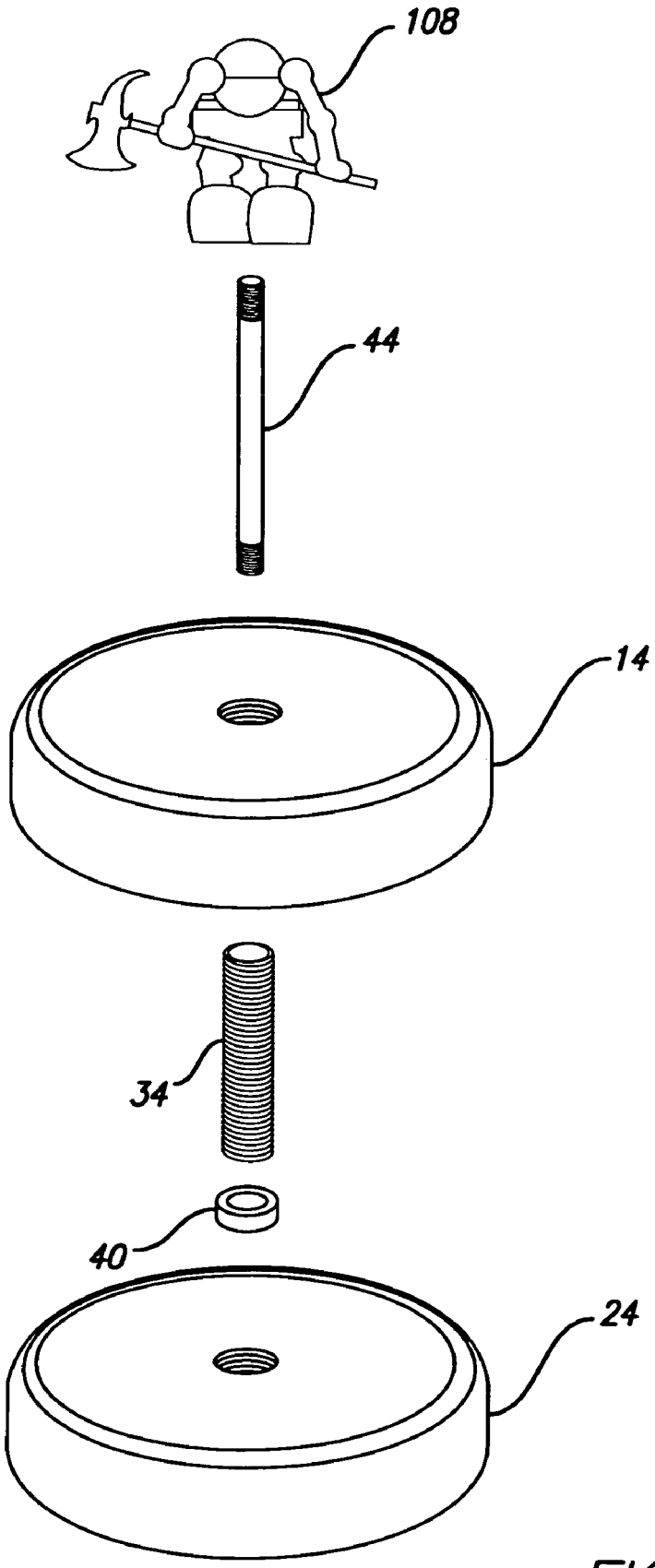
FIG. 6 is an exploded view of a partial yo-yo configuration of the present invention for use with a removable toy miniature figure.
Figure 10:
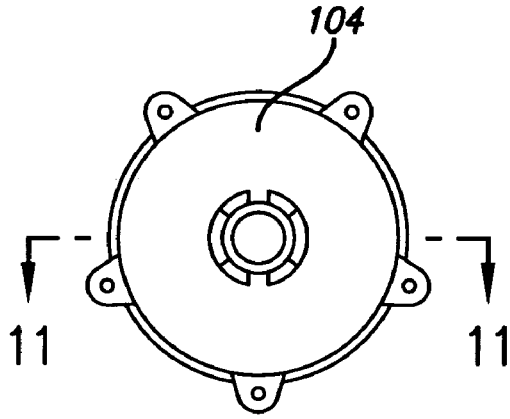
FIG. 10 is a top view of the second cover element.
Figure 28:
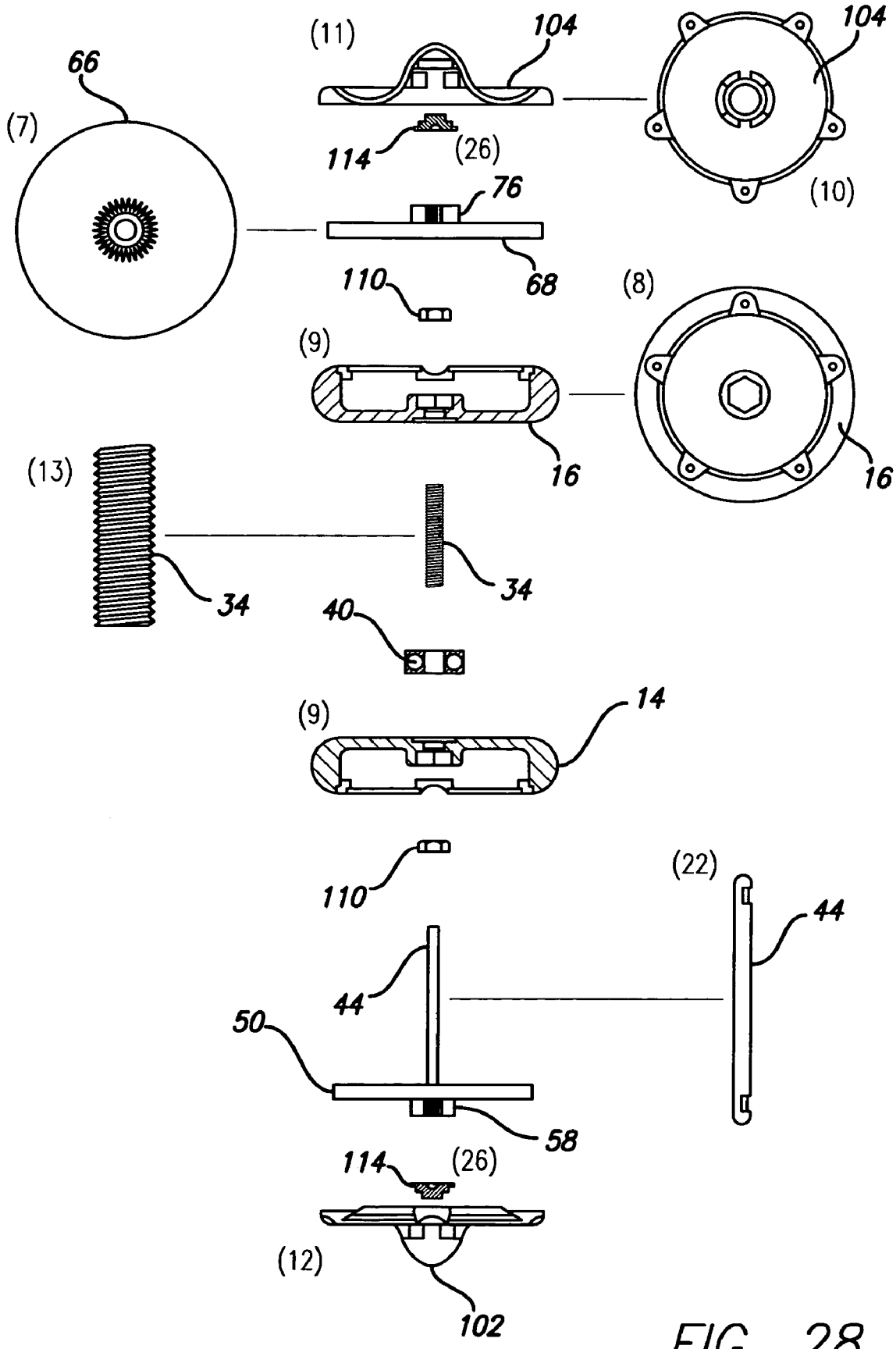
FIG. 28 is an exploded sectional view of another embodiment of the device of the present invention, showing the yo-yo configuration and top configuration.

FIG. 4 is a perspective view of another embodiment of the device of the present invention. The device 10 may further comprise at least one removable top component adapted to be secured to the yo-yo body to convert the device from a yo-yo to a top. The top component may comprise first cover element 102 and second cover element 104, as shown in FIG. 28. FIG. 10 is a top view of the second cover element. FIG. 11 is a cross-sectional view taken along line 11-11 of FIG. 10. FIG. 12 is a side view of the first cover element. These cover elements 102, 104 may have rounded central tips or points that act as contact points when the device is used as a top. As an alternative to the cover elements 102, 104 having rounded tips built into the cover elements, one or both cover elements 102, 104 may be removed and one or more tip portions 106 may be fitted and coupled to the exterior of one or both of the respective yo-yo body halves in place of the removed cover element or elements. Preferably, the tip portion 106 is cone-shaped or rounded to maximize the spinning capacity of the top. The device may further comprise one or more additional components selected from the group comprising lighting components, electronic components, sound components, or miniature figure components. FIG. 6 is an exploded view of a partial yo-yo configuration of the present invention for use with a removable toy miniature FIG. 108.

Figure 20:
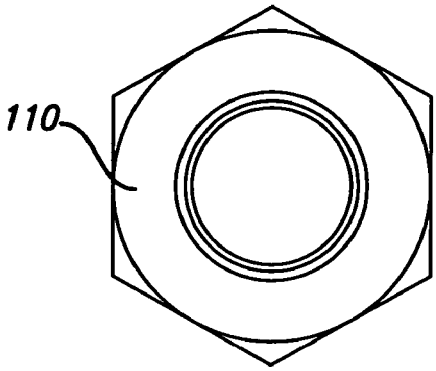
FIG. 20 is a top view of a nut portion used with the present invention.
Figure 21:
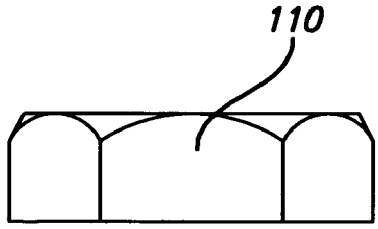
FIG. 21 is a side view of the nut portion of FIG. 20.
Figure 23:
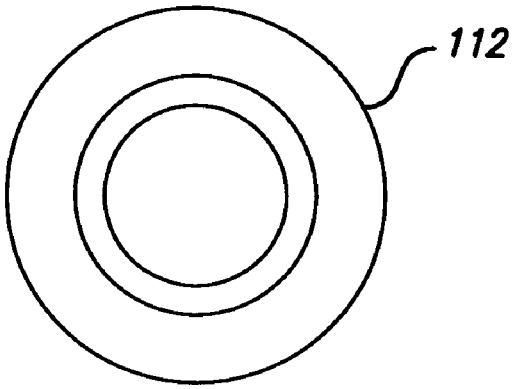
FIG. 23 is a top view of a bearing washer used with the present invention.
Figure 24:
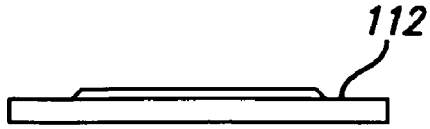
FIG. 24 is a side view of the bearing washer of FIG. 23.
Figure 25:
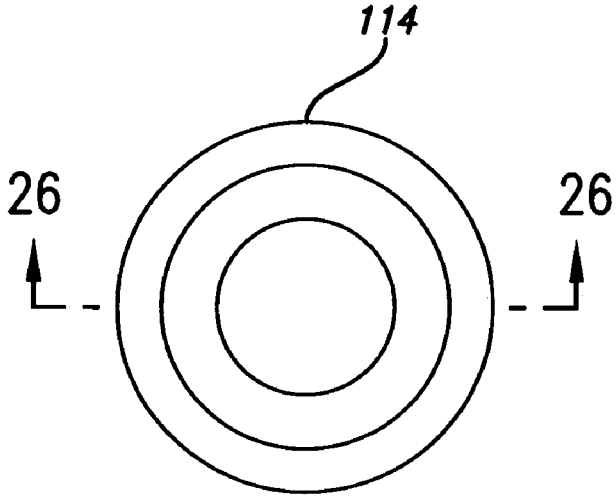
FIG. 25 is a top view of a flywheel ball bearing of the present invention.
Figure 26:
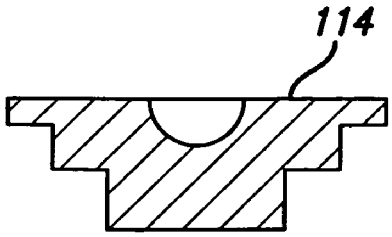
FIG. 26 is a cross-sectional view taken along line 26-26 of FIG. 25.
Figure 27:
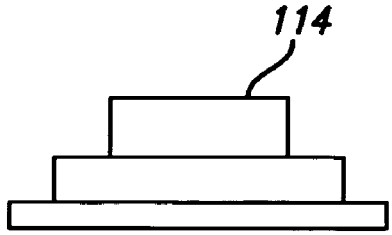
FIG. 27 is a side view of the flywheel ball bearing of FIG. 25.

The device of the present invention may also comprise some other additional components such as nut portions 110, bearing washers 112, flywheel ball bearings 114, countersink screws (not shown), and other screws and attachment means. FIG. 20 is a top view of a nut portion. FIG. 21 is a side view of the nut portion. FIG. 23 is a top view of the bearing washer. FIG. 24 is a side view of the bearing washer. FIG. 25 is a top view of a flywheel ball bearing. FIG. 26 is a cross-sectional view taken along line 26-26 of FIG. 25. FIG. 27 is a side view of the flywheel ball bearing. In another embodiment shown in FIG. 28, the present invention is directed to a yo-yo comprising: a yo-yo body having first and second yo-yo body halves; a hollow dowel element; a ball bearing element; a first flywheel assembly having an elongated flywheel axle; a second flywheel assembly; a string element; a top component in the form of cover elements having central rounded portions' and a power element such as a zip cord. FIG. 28 is an exploded sectional view of another embodiment of the device showing the yo-yo and top configurations.

The unique features of the combination yo-yo and top of the present invention is an incorporated pair of flywheel assemblies that may be powered by the ratcheted zip cord or the electric charger, in combination with the string element. When the invention is assembled, the elongated flywheel axle portion is inserted through both flywheel assemblies, both yo-yo body halves, the ball bearing, and the hollow core axle. The flywheels can rotate independently of the yo-yo bodies. Powered up by the ratcheted zip cord pulled over one of the gear portions and guided through the slots on one of the yo-yo body halves, the flywheels spin at a greater speed than the speed of what many known yo-yo's alone are capable of, thus making the yo-yo of the present invention itself increase in speed. The device achieves this speed because of the free spinning flywheels. The use of a hollow dowel allows the flywheels to spin together, as well as independently of the yo-yo body halves and faster than the yo-yo body halves. The motion of the flywheels forces the spinning speed of the yo-yo body halves to increase beyond the speed normally created by a user throwing the yo-yo alone. The critical hollow dowel and first and second flywheel assemblies are unique components of the invention.

The flywheel assemblies may be powered by the use of the ratcheted zip cord device that is inserted into the slots on either the yo-yo body halves or cover elements. A user connects the zip cord to the gear portion of the respective flywheel, and then the user pulls the zip cord through the slots in a fast motion that causes the flywheel to spin at an accelerated speed. When the user begins playing with the yo-yo, the centrifugal force of the spinning flywheels causes the yo-yo to spin faster than many existing yo-yo's. This accelerated speed enhances the play of the yo-yo, particularly if the user is adept at doing any of the innumerable yo-yo tricks that have been developed over the years. The electric charger component may be used in place of the zip cord to "super charge" the speed and spinning of the yo-yo and/or top. The invention has the additional advantage of allowing the user to play with it as a top. The two yo-yo halves are constructed so that they can be taken apart and replaced with other parts that allow for other types of play. The cover elements may have built in rounded tips so that when the yo-yo is turned on its side, it can act as a top. In another embodiment, one or more of the cover elements may be replaced with tip portions for use as a top. The top may be powered either by the power element, preferably, in the form of the zip cord or the electric charger, and may be used in combination with the string. Thus, the present invention further incorporates modularity so that it can be converted and used as a top.

Although the present invention has been described in considerable detail with reference to certain preferred aspects thereof, other aspects of the invention are possible. Therefore, the scope of the appended claims should not be limited to the description of the preferred aspects contained herein.

What is claimed is:

1. A combination yo-yo and top device comprising:

a yo-yo body having first and second yo-yo body halves each having an interior side, an exterior side, a rim, and central opening;

an externally threaded hollow dowel element detachably connecting one of the yo-yo body halves to the other;

a ball bearing element mounted on the hollow dowel element between the yo-yo body halves;

a first flywheel assembly having an elongated flywheel axle, wherein the first flywheel assembly is adapted for attachment to the yo-yo body;

a second flywheel assembly adapted for attachment to the yo-yo body;

a string element having a first end coupled to the hollow dowel element;

a power element adapted for attachment to either the first flywheel assembly or second flywheel assembly to activate both flywheel assemblies; and at least one removable top component adapted to be secured to the yo-yo body to convert the device from a yo-yo to a top.

2. The device of claim 1 wherein the first flywheel assembly further comprises a first flywheel having a central opening and a first gear portion having a central opening, wherein the first gear portion is adjacent the first flywheel, such that the elongated flywheel axle is inserted through the first flywheel central opening and through the first gear central opening when the device is assembled.

3. The device of claim 1 wherein the second flywheel assembly comprises a second flywheel having a central opening and a second gear portion having a central opening, wherein the second gear portion is adjacent the second flywheel, such that the elongated flywheel axle is inserted through the second flywheel central opening and through the second gear central opening when the device is assembled.

4. The device of claim 1 wherein the first yo-yo body half contains at least two slots formed in the rim of the first yo-yo body half.

5. The device of claim 1 wherein the second yo-yo body half contains at least two slots formed in the rim of the second yo-yo body half.

6. The device of claim 1 wherein the top component comprises a first removable cover element for coupling to the exterior side of the first yo-yo body half, and a second removable cover element for coupling to the exterior side of the second yo-yo body half.

7. The device of claim 6 wherein the first cover element contains at least two slots formed in first cover element.

8. The device of claim 6 wherein the second cover element contains at least two slots formed in second cover element.

9. The device of claim 1 wherein the top component comprises a tip portion that may be coupled to one or both of the yo-yo body halves.

* * * * *